US005941812A

United States Patent [19]

Grüning et al.

[11] Patent Number: 5,941,812

[45] **Date of Patent: *Aug. 24, 1999**

[54] STORAGE-STABLE, CONCENTRATED SURFACTANT COMPOSITION BASED ON ALKYLGLUCOSIDES

[75] Inventors: Burghard Grüning; Christian Weitemeyer, both of Essen, Germany

[73] Assignee: Th. Goldschmidt AG, Essen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/666,658

[22] Filed: Jun. 14, 1996

[30] Foreign Application Priority Data

Jun. 20, 1995 [DE] Germany ..... 195 22 233

[51] Int. Cl.[6] ..... B01F 17/56; C11D 1/04

[52] U.S. Cl. ..... 516/75; 516/204; 516/919; 510/470; 510/437

[58] Field of Search ..... 252/356, 312; 510/339, 506, 527, 470, 437; 424/70.31; 514/846; 516/75, 204, 919

[56] References Cited

U.S. PATENT DOCUMENTS

| | | | |
|---|---|---|---|
| 4,212,760 | 7/1980 | Baur et al. | 510/339 |
| 4,240,921 | 12/1980 | Kaniecki | 252/358 |
| 4,565,647 | 1/1986 | Llenado | 252/354 |
| 5,352,376 | 10/1994 | Gutzmann | 508/216 |
| 5,389,282 | 2/1995 | Saijo et al. | 510/237 |
| 5,534,500 | 7/1996 | Casamassina et al. | 252/357 |
| 5,556,573 | 9/1996 | Weuthen et al. | 510/537 |
| 5,562,848 | 10/1996 | Wofford et al. | 510/328 |
| 5,565,141 | 10/1996 | Baur et al. | 252/312 |
| 5,567,808 | 10/1996 | Desai et al. | 536/4.1 |
| 5,605,651 | 2/1997 | Balzer | 252/312 |
| 5,783,553 | 7/1998 | Desai et al. | 510/470 |

FOREIGN PATENT DOCUMENTS

| | | |
|---|---|---|
| 0 301 298 B1 | 7/1988 | European Pat. Off. . |
| 42 25 224 A1 | 2/1994 | Germany . |
| WO 90/03977 | 4/1990 | WIPO . |

OTHER PUBLICATIONS

Database WPIDS on STN, week 9517, London: Derwent Publications Ltd., AN 95–131304, Class D25, WO 9507916 A1 (Casamassina et al.) abstract., 1995.

*Primary Examiner*—Richard D. Lovering
*Assistant Examiner*—Daniel S. Metzmaier
*Attorney, Agent, or Firm*—Scully, Scott, Murphy & Presser

[57] ABSTRACT

The invention relates to a storage-stable, concentrated, aqueous surfactant composition comprising a) 40 to 75% by weight of one or more alkylglucosides of the formula $$R^1O—[G]_p \quad (I)$$

wherein $R^1$ is an alkyl radical having 6 to 22 C atoms, in particular 12 to 18 C atoms, and G is the glucoside radical and P is a number from 1 to 3, b) 1 to 15% by weight of a fatty acid, c) 0 to 5% by weight of an electrolyte of alkali metal or alkaline earth metal halides and d) 5 to 59% by weight of water.

4 Claims, No Drawings

STORAGE-STABLE, CONCENTRATED SURFACTANT COMPOSITION BASED ON ALKYLGLUCOSIDES

FIELD OF THE THE INVENTION

The invention relates to a storage-stable, concentrated surfactant composition based on alkylglucosides with an addition of fatty acids as a stabilizing agent.

BACKGROUND OF THE INVENTION

Alkylglucosides are known substances. They correspond to the general formula $$R—O—[G]_p$$

in which R is derived from a fatty alcohol radical and G is the glucose radical. One or more glucose radicals can be bonded to a fatty alcohol radical, which results in an average degree of oligomerization p over the glucose units. The terms alkyl polyglucoside and alkyl oligoglucoside are therefore also used for this group of products in the literature.

Alkylglucosides are important nonionic surfactants which, as a result of their good detergent properties and high environment-friendliness, have found use to an ever greater extent in washing, rinsing and cleaning compositions.

For this purpose, it is necessary to have available and to store alkylglucosides over certain periods of time, for example as aqueous solutions or pastes, until final processing takes place. However, since aqueous alkylglucosides show a marked tendency toward crystallization, agglomerates which contain water of crystallization and greatly reduce the pumpability of the products are formed in the course of time during storage under ambient conditions.

These problems occur in particular with alkylglucosides in which the alkyl radical has 12 or more C atoms and with commercially available alkylglucoside mixtures in which the higher-chain content is correspondingly high and contains alkyl radicals having 12 or more C atoms to the extent of more than 50%.

Alkylglucosides are therefore usually stored not at room temperature but at temperatures of at least 35° C. Although crystallization of the formulations can be largely prevented in this manner, storage at elevated temperature is associated with additional expenditure and can furthermore severely impair the color quality of the products.

To improve the resistance to crystallization, DE-A-42 25 224 proposes the addition of a number of "crystallization moderators", such as, for example, alkyl oligoglycosides based on short-chain alcohols, polyethylene glycol or iron (III) ions, but these have the disadvantage that they impair the surfactant properties or the color.

It is thus an object of the present invention to discover a concentrated surfactant composition based on alkylglucosides, with which storage of the glucosides at temperatures below 35° C. is possible without the pumpability of the products being impaired by formation of crystalline agglomerates.

BRIEF SUMMARY OF THE INVENTION

The invention thus relates to a storage-stable, concentrated, aqueous surfactant composition comprising a) 40 to 75% by weight of one or more alkylglucosides of the formula $$R^1O—[G]_p$$

wherein $R^1$ is an alkyl radical having 6 to 22 C atoms, in particular 12 to 18 C atoms, G is the glucoside radical and p is a number from 1 to 3, b) 1 to 15% by weight of a fatty acid, c) 0 to 5% by weight of an electrolyte of alkali metal or alkaline earth metal halides and d) 5 to 59% by weight of water.

In a particularly preferred embodiment, at least 50% of the radicals $R^1$ have 12 or more C atoms.

A preferred distribution of alkyl radicals in the alkylglucoside is

| | |
|---|---|
| $C_8$ | <3% |
| $C_{10}$ | <3% |
| $C_{12}$ | 50 to 100% |
| $C_{14}$ | 10 to 40% |
| $C_{16}$ | 0 to 15% |
| $C_{18}$ | 0 to 10% |

DETAILED DESCRIPTION OF THE INVENTION

It has now been found, surprisingly, that in the concentrated surfactant compositions according to the invention, the tendency of the longer-chain alkylglucosides toward crystallization is reduced to the extent that concentrated, aqueous compositions which show no tendency toward crystallization even at temperatures below 35° C. and are storage- and color-stable for months can be prepared. These mixtures are thus also stable and storable at customary ambient temperatures in the range from 10 to 25° C.

As already mentioned above, alkylglycosides are known substances which can be obtained from fatty alcohols and reducing sugars (see, for example, EP-A1-O 301 298 and WO 90/3977).

The alkylglycosides can be derived from aldoses or ketones having 5 or 6 carbon atoms, preferably glucose. Only the alkylglucosides have acquired industrial importance here.

The index number p in the general formula (I) indicates the degree of oligomerization, i.e. the distribution of mono- and oligoglucosides, and is a number between 1 and 3. While p must always be an integer in a given compound, the value p is an analytically determined mathematical parameter, which is usually a fraction, for a particular alkylglucoside. Alkylglucosides having an average degree of oligomerization p of 1.1 to 3.0 are preferably employed. From the point of view of use, those alkylglucosides in which the degree of oligomerization is less than 1.7, and in particular between 1.2 and 1.6, are preferred.

The alkyl radical $R^1$ can be derived from primary alcohols having 4 to 22, preferably 12 to 14, carbon atoms. These are typically in the form of technical grade mixtures.

Suitable fatty acids are naturally occurring or synthetic fatty acids having 8 to 18 carbon atoms, or mixtures, including the naturally occurring fatty acid compositions, such as, for example, coconut fatty acid or palm kernel fatty acid, being preferred.

A higher content having an average chain length of 12 to 14 carbon atoms is preferred here. The fatty acids are preferably employed in amounts of 2.5 to 10% by weight, in particular 5 to 7.5% by weight.

If appropriate, alkali metal or alkaline earth metal halides are added to the mixture as an electrolyte, sodium chloride usually being used.

As a rule, the electrolyte is added in solid form or also from a concentrated aqueous solution. This can be effected at any point in time of the preparation of the mixture, if appropriate preferably before final adjustment of the pH of the formulation.

If necessary, the pH of the formulation is finally adjusted to a pH of ≦8, preferably ≦6, by addition of a mineral acid or an organic acid.

Preferred acids are phosphoric acid, hydrochloric acid, sulfuric acid, tartaric acid, citric acid and lactic acid.

The mixtures according to the invention can also be prepared by simple mixing of commercially available alkylglucoside solutions and fatty acids. Mixing can take place at room temperature or, in order to achieve a lower viscosity, at a slightly elevated temperature of 30 to 80° C. The mixtures can of course also be prepared from solid starting substances by dissolving in water.

The formulations according to the invention are in general resistant to microbial attack. This applies in particular at pH values of <6. They can be further improved in their microbiological stability by addition of alkali metal or alkaline earth metal halides.

The surfactant compositions according to the invention are storage-stable and show no tendencies toward crystallization. They have an excellent surfactant action and have outstanding dirt-dissolving and at the same time skin-friendly properties. They are suitable for the preparation of washing, rinsing and cleaning compositions and products for hair and body care, in which they are usually employed in amounts of 3 to 30% (based on the aqueous formulation).

Customary contents, such as cosurfactants, builders, dyestuffs, viscosity regulators and fragrances, can be added, depending on the intended use.

EXAMPLES

Comparison Example (not according to the invention)

A dry alkylglucoside which comprised about 4% by weight of water was dissolved in water so that a solution having a solids content of 50% by weight was formed. The pH of the solution was 7.

The alkylglucoside was characterized as follows (% by weight):

| | | |
|---|---|---|
| composition of the alkyl radicals: | $C_8$ | 10% |
| | $C_{10}$ | 10% |
| | $C_{12}$ | 58% |
| | $C_{14}$ | 14% |
| | $C_{16}$ | 6% |
| | $C_{18}$ | 2% |
| degree of oligomerization: | n = 1.26 | |

The solution was divided and stored in closed vessels at temperatures of 20 to 40° C. The sample stored at 20° C. was white and solid after 14 days, while the sample stored at 40° C. was still liquid even after storage for 6 months. However, it had become significantly darker in color during storage.

Example 1

(according to the invention)

A solution was prepared from the dry alkylglucoside described in the comparison example described above, coconut fatty acid, water and a little aqueous concentrated sodium hydroxide solution, the solution having the following composition (% by weight):

alkylglucoside: 60% water: 35% hardened coconut fatty acid: 5% sodium hydroxide solution to pH 7

The solution was divided and stored in closed vessels at temperatures of 20 and 40° C. for 6 months. After this storage time, the samples were homogeneous and capable of flow; no formation of crystals nor formation of precipitates could be detected in any of the samples.

Example 2

(according to the invention)

A solution was prepared in a manner similar to Example 1 from a dry alkylglucoside, which comprised about 3% by weight of water, lauric acid, water, aqueous, concentrated hydrochloric acid and sodium chloride, the solution having the following composition (% by weight):

alkylglucoside: 41.8% water: 49.0% lauric acid: 7.2% sodium chloride: 2.0% hydrochloric acid to pH 5

The alkylglucoside was characterized as follows (% by weight):

| | | |
|---|---|---|
| composition of the alkyl radicals: | $C_8$ | 1% |
| | $C_{10}$ | 1% |
| | $C_{12}$ | 68% |
| | $C_{14}$ | 25% |
| | $C_{16}$ | 5% |
| Degree of oligomerization: | n = 1.52 | |

After storage of this solution under the same conditions as in Example 1, these solutions were also homogeneous and capable of flow. No formation of crystals nor formation of precipitates could be detected in any of the samples.

The solution was furthermore subjected to a microbiological exposure test in accordance with DAB 10 (German Pharmacopeia). The formulation proved to be microbiologically stable in this test.

What is claimed is:

1. A storage-stable, concentrated, aqueous surfactant composition consisting of a) 40 to 75% by weight or one or more alkylglucosides of the formula $$R^1O—(G)_p \quad (I)$$

wherein $R^1$ is an alkyl radical having 6 to 22 C atoms,

G is the glucoside radical and p is a number from 1 to 3, b) 1 to 15% by weight of a fatty acid having 8 to 18 carbon atoms, c) 0 to 5% by weight of an electrolyte selected from the group consisting of alkali metal halides and alkaline earth metal halides, d) 5 to 59% by weight of water and e) a mineral acid or a second organic acid in an amount sufficient to adjust the pH of the composition to 6 or less than 6.

2. A surfactant composition according to claim 1, wherein said one or more alkylglucosides are a mixture of alkylglucosides of formula (I) which differ in the number of C atoms in $R^1$, wherein at least 50% of the radicals $R^1$ have 12 to 22 C atoms.

3. A surfactant composition according to claim 1 wherein said one or more alkylglucosides are a mixture of alkylglucosides of formula (I) which differ in the number of C atoms in $R^1$, wherein at least 50% of the radicals $R^1$ have 12 to 18 C atoms.

4. A surfactant composition according to claim 3 wherein $R^1$ is an alkyl radical having 12 to 18 C atoms.

* * * * *